United States Patent [19]

Williams

[11] Patent Number: 5,042,119

[45] Date of Patent: Aug. 27, 1991

[54] SECUREMENT, CONCEALMENT AND CONTAINMENT OF FOOTWEAR LACE ENDS

[76] Inventor: Timothy G. Williams, 5169 W. 10400 North, Highland, Utah 84003

[21] Appl. No.: 546,126

[22] Filed: Jun. 28, 1990

[51] Int. Cl.[5] ..... A43C 9/00; A44B 18/00; A43B 11/00

[52] U.S. Cl. ..... 24/712.3; 24/712.6; 24/442; 36/50

[58] Field of Search ..... 24/712.3, 712.5, 712.6, 24/713.2, 713.4, 306, 442, 163 K; 36/50, 131

[56] References Cited

U.S. PATENT DOCUMENTS

| | | | |
|---|---|---|---|
| 2,022,554 | 11/1935 | Williams | 24/712.3 |
| 3,618,235 | 11/1971 | Cary, Jr. | 36/50 |
| 4,291,439 | 9/1981 | Riti | 24/119 |
| 4,414,761 | 11/1983 | Mahood | 36/50 |
| 4,428,101 | 1/1984 | Harkavy | 24/119 |
| 4,545,138 | 10/1985 | Blum | 36/51 |
| 4,553,293 | 11/1985 | Blum | 36/50 |
| 4,571,854 | 2/1986 | Edens | 36/50 |
| 4,628,622 | 12/1986 | McBarron | 36/50 |
| 4,780,936 | 11/1988 | Breecher | 24/119 |
| 4,794,674 | 1/1989 | Mintel et al. | 36/50 |
| 4,845,864 | 7/1989 | Corliss | 36/50 |
| 4,949,437 | 8/1990 | Anderson | 24/712.6 |

*Primary Examiner*—Victor N. Sakran
*Attorney, Agent, or Firm*—Lynn G. Foster

[57] ABSTRACT

Devices and methods for containing tied lace ends on footwear. Each tied lace ends containment device comprises members which affix the device to a shoe, enclose otherwise loose tied lace ends including the bow to eliminate or greatly alleviate the danger, annoyance of freely dangling lace ends, and firmly securely engage the tie lace containment. A pocket is disclosed provided for conveniently carrying valuables or other small items on the footwear during an activity. Opportunity for placement of fashionable designs or personal identification or the like is provided.

43 Claims, 3 Drawing Sheets

SECUREMENT, CONCEALMENT AND CONTAINMENT OF FOOTWEAR LACE ENDS

FIELD OF INVENTION

The present invention relates to footwear and more particularly to devices for and method of securing, concealing and containing the ends of footwear tie laces.

DESCRIPTION OF RELATED ART

Athletic shoes, sneakers, boots, dress shoes, jogging shoes and other footwear which utilize a lace to securely fasten the footwear on the foot of the wearer require that the laces be tied together in some manner so as to prevent the laces from loosening. In most instances, the laces are tied together in a single or multiple bow-knot. Once the bow-knot has been tied, the laces at and near the knot are then left loose to freely swing about the top of the shoe as the wearer moves his foot. This causes wear to the lace ends and sometimes results in damage, thereby shortening the useful life of the laces and sometimes making relacing through the eyelets of the shoe difficult. Unrestrained tied laces can produce a substantial risk of catching the free swinging laces on objects which can cause the wearer to trip and fall and possibly receive injuries. Particularly is this true with children who not only catch their laces on objects, but frequently trip on the laces themselves.

In addition to the risks of catching or hooking the swinging laces on objects, some people find the motion of the free swinging laces slapping against the top of their foot during athletic activities such as jogging or aerobics, annoying, uncomfortable, distracting and objectionable.

Another result of the tied lace ends swinging freely from the footwear is that the laces can touch and drag on the ground. When such configured footwear is worn in wet, muddy, or some other undesirable wet environment such as that caused by the weather, a spill or another such event, the laces then pick up objectionable substances and transfer them to the footwear itself and/or to the wearers lower garments causing stains.

In addition to the risks of catching or hooking the swinging laces on objects, the possibilities of stepping and tripping on the hanging laces; the annoyance and discomfort of the free swinging laces slapping against the foot; and the opportunity of staining and soiling which occurs when objectionable substances are picked up from the hanging laces and transferred to the footwear and/or lower garments, additional annoying, hazardous and inconvenient conditions result when the bow-knot becomes loosened or untied. In fact all of the aforementioned objections become exacerbated when the bow-knot becomes untied, resulting in full length exposure of the available lace to the enumerated risks.

The results of a loosened or untied shoe lace creates universal annoyance, inconvenience and risks not only associated with the free swinging laces, but the opportunity for the shoe being dislodged from the foot. Particularly with respect to athletic activities when such an occurrence often requires that activities be halted until the laces are re-tied.

With respect to children in their play activities, loosening of the bow-knot creates a persistent and often frustrating burden on parents, teachers and other more dexterous persons to the task of retying the laces.

Heretofore, a variety of devices have been suggested to prevent the bow-knot from loosening or becoming untied, however all of them address only the issue related to securing the bow-knot from loosening or becoming untied and or a method of knotless fastening. Thus U.S. Pat. Nos. 4,780,936, 4,291,439, 4,428,101, 4,553,293 and 4,571,854 which include strips of interlocking materials (including hook and loop elements) only address the securing of the bow-knots of tied laces and/or engagement of the laces to provide a knotless fastening.

Thus, while prior proposals exist to meet the sole objective of securing bow-knots, there is a need for a device which provides the actual retainment and/or containment of the laces from swinging freely from the footwear, with the additional result of preventing the same from unloosening, or becoming untied. With the state of the art as described above it would be advantageous (a) to better secure, contain and/or conceal freely swinging tied lace ends at a location on top of the footwear tied to thereby prevent or greatly reduce the risks of the loose laces catching or hooking on objects and the possibility of stepping and tripping on the hanging laces; (b) to provide a containment closure for free swinging tied lace ends which prevent the same from coming in contact with wet or foreign substances on walking or running surfaces which otherwise would be transferred to the footwear and/or lower garments; and/or (c) to provide a fastening device for the tied ends of a shoe lace which prevents the lace ends from the annoyance and discomfort caused by the free swinging tied lace ends slapping against the foot and substantially prevent staining and soiling which would otherwise occur to the footwear and/or lower garments from objectionable substances picked up from such free swinging laces and transferred thereto.

BRIEF SUMMARY AND OBJECTS OF THE INVENTION

In accordance with the present invention, novel footwear tied lace ends containment devices and related methods are provided whereby each device is interlaced or otherwise attached to a piece of footwear and, after the lace ends are tied or gathered together by the wearer, is used to releasibly enclose and/or conceal at least part of each tied lace end firmly on top of the footwear thereby alleviating safety and other discomforting and annoying problems associated with freely swinging tied lace ends. The devices also usefully prevent the untying of a bow-knot and resulting loosening of the laces. The devices may be releasible to accommodate removal and exchange from one footwear to another or permanently attached where at least one part of a device is a permanent part of the footwear or the lace. A pocket in the device may be used to provide safe and comfortable storage for an item while an activity involving the footwear is in progress. In addition to securing, covering, encasing, and concealing the tied ends of laces, the exterior provides opportunity for display of advertising and other messages, identification or other indicia.

Accordingly, it is a primary object to provide a footwear tied lace ends containing device which is affixable to a part of the footwear, restrainingly encloses, conceals, contains and/or secures at least a portion of tie lace ends, and is releasible.

It is a principal object to provide a footwear tied lace ends containing device wherein all connections are releasible.

It is a further principal object to provide a footwear tied lace ends containing device which comprises a pocket for transport of small items such as keys, paper money and small coins, and other small objects for secure transport while engaging in activity involving the footwear.

It is a major object to provide a footwear tied lace ends containing device which is releasibly attachable to at least one secure segment of the footwear tie lace.

It is yet another major object to provide a footwear tied lace ends containing device of which at least one part is permanently affixable to the footwear and/or lace.

It is a fundamental object to provide a footwear tied lace ends containing device wherein all connections are releasibly made using releasible compressibly affixing material, such as hook and loop fasteners.

It is a further fundamental object to provide a footwear tied lace ends containing device which is made solely by cutting and stamping of material.

It is a central object to provide a footwear tied lace ends containing device which at least partially covers, encases, and conceals tied lace ends, and provides a visible exterior which further provides for the display of messages, identification, indicia, designs and/or decorations.

It is a further central object to provide a footwear tied lace ends containing device comprising decorative indicia.

It is a main object to provide a footwear tied lace ends containing device comprising removable and substitutable parts, such that the appearance of the footwear due to exhibited indicia can be readily changed.

It is a chief object to provide a footwear tied lace ends containing device which also secures and restrains bow-knots from untying.

These and other objects and features of the present invention will be apparent from the detailed description taken with reference t accompanying drawings.

DETAILED DESCRIPTION OF THE ILLUSTRATED EMBODIMENTS

In this description, the term proximal is used to indicate the segment of a tie lace containment device, closer the most superior tip of the tongue of a shoe. The term distal references a direction toward the toe of the shoe.

Figure 1:
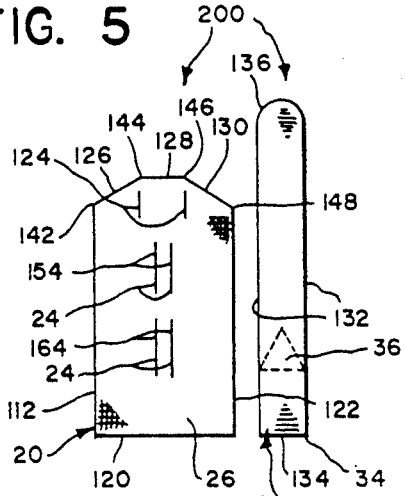
FIG. 1 is a schematic plan view of a pattern for a two piece tied lace ends containment device.

Reference is now made to the embodiments illustrated in FIGS. 1–14, wherein like numerals are used to designate like parts throughout. FIG. 1 shows a pattern layout or die cut pieces for one presently preferred embodiment, generally designated 200, of this invention. Tied lace containment device 200 comprises two essentially planar releasibly joinable members, i.e., an enclosing member 20 and an engaging member 30. Enclosing member 20 is illustrated as being a swatch of material which may be approximately two inches wide and three and three-fourths inches long. However, other enclosing members 20, within the scope of this invention, may comprise different widths and lengths. Enclosing member 20 comprises a straight proximal side 120 from which two edges 112 and 122 extend normal thereto and in a distal direction to end-points 142 and 148, respectively. At distal end-points 142 and 148, two centrally directed straight edges 126 and 130, respectively, extend therefrom to distal end-points 144 and 146, respectively, leaving a medial distal end segment 128 symmetrically disposed between sides 112 and 122.

Slits, generally designated 24, through which a tie lace is threaded to affix enclosing member to a shoe, are symmetrically cut in separated pairs along the length of enclosing member 20, as shown in FIG. 1. Proximal from distal end segment 128 and separated by substantially the length of distal end segment 128, a pair of longitudinal slits 124 are cut such that the two slits 124 are symmetrically disposed the same distance from each outer edge 112 and 122. Disposed proximal from slits 124 are two narrowly separated slits 154, symmetrically placed between edges 112 and 122. Additionally, at least one pair of successively more proximally disposed slits 164, also symmetrically placed between edges 112 and 122, is placed with a separation from each more distal pair of slits 24, forming a slit pattern toward the proximal end of enclosing member 20.

Engaging member 30 comprises a distally used edge 134 from which two long edges 132 extend in a normal direction to join a proximally used edge 136, formed as a semicircular cut.

Tied lace ends containment device 200 employs complementary hook and loop fasteners for engagement between enclosing member 20 and engaging member 30. As shown in FIG. 1, enclosing member 20 comprises material comprising loops on one side. Engaging member 30 comprises hooks on the underside thereof. As described later, when compressibly engaging tied lace ends and disposed in a containing position, a major portion of the upper side 34 of engaging member 30 is visible, providing an opportunity to display visual representation 36 of patterns and colors on the upper side 34 for a fashion statement or company, personal, team identification, or other indicia, identification or advertising. To provide such visual representation 36, colored materials may be bonded, sewn, or otherwise added to each upper side 34 of at least one engaging member 30.

In other preferred embodiments, other materials may be used for enclosing member 20 and engaging member 30. As an example, a thermally formable synthetic resinous material may be used to make enclosing member 20. After cutting such an enclosing member to pattern, the sides 112 and 122 are bent or folded medially such that proximal edge 120 forms a circle or ellipse and enclosing member 20 becomes generally cylindrical with a lengthwise slit along edges 112 and 122. When in use, such an enclosing member holds laces in place without further use of an engaging member, thus the enclosing member comprises functions associated with affixing, securing, enclosing, containing, concealing and engaging. Other alternate methods and devices for enclosing and holding laces in a tied lace ends are described in greater detail hereafter.

Figure 2A:
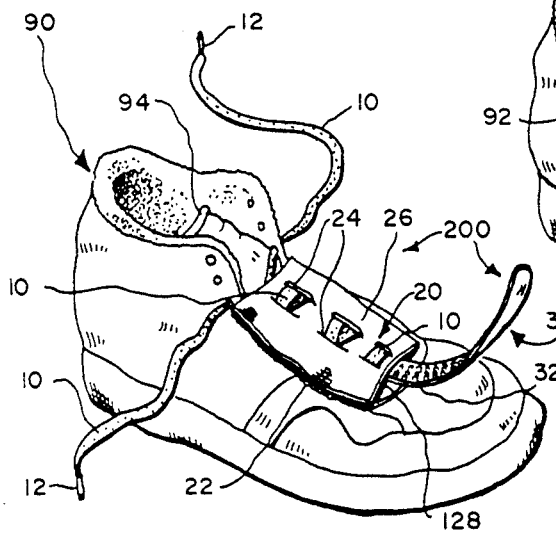
FIG. 2A is perspective view of the shoe and two piece tie lace containment device shown in FIG. 2 with the engaging member releasibly attached to the enclosing member which is fully attached to the shoe by tie laces threaded through slots in the enclosing member.
Figure 2:
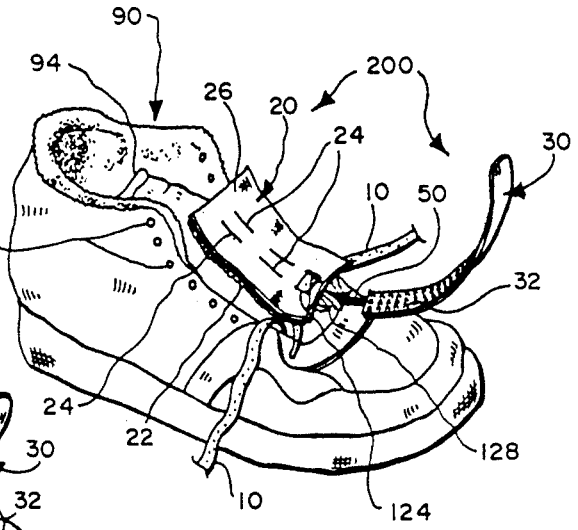
FIG. 2 is a perspective view of a two piece tied lace ends containment device, made from the pattern shown in FIG. 1, with an enclosing member of the containment device partially affixed to a shoe and a tongue like engaging member unattached.
Figure 2C:
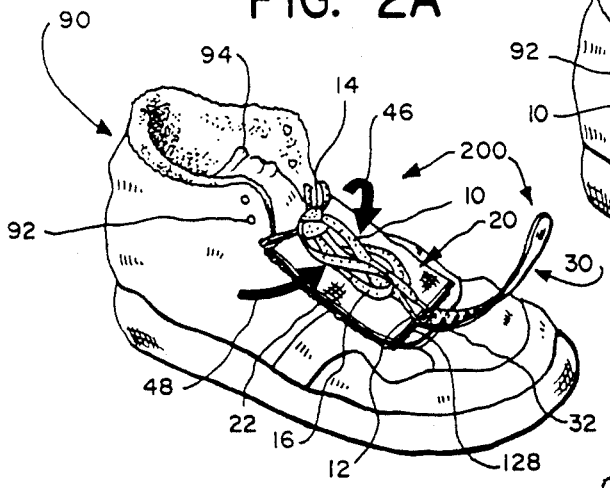
FIG. 2C is a perspective view of the shoe and lace containment device shown in FIG. 2B with shoe lace ends gathered and aligned upon the enclosing member of the containment-device.

Reference is now made to FIGS. 2 and 2A through 2D wherein affixation of the device 200 to a shoe, generally designated 90, and of enclosing tied lace ends 10 and engaging the enclosing member to contain the tied lace ends 10 are disclosed step-by-step. Shoe 90 comprises tie lace apertures 92, two tied lace ends 10, and a tongue 94. See FIG. 2. Therein enclosing member 20 is seen partially affixed to the shoe by threading the lace through distal slits 124. Loop fastener side 22 of enclosing member 20 is disposed against shoe 90, leaving the inner closing side 26 of enclosing member 20 upwardly open at this stage. Engaging member 30 is shown in FIG. 2 with hook fastener side 32 facing upwardly and, as yet, unconnected to enclosing member 20. Arrow 50 shows the path of displacement by engaging member 30 to move a portion of hook fastener side 32 under distal end segment 128 to a position where a releasibly hook/-loop connection is made with loop fastener side 22, providing distal releasible affixed engagement between enclosing member 20 and engaging member 30. By threading the lace consecutively through eyelets 92 of the shoe and the aligned slits 24, the enclosing member becomes fully secured to the shoe 90. A completely shoe affixed enclosing member 20 is seen in FIG. 2A, with the lace threaded through all available slits 24 and associated eyelets 92 of shoe 90. Also engaging member 30 is shown releasibly fastened to the distal end of enclosing member 20 at the underside thereof.

Figure 2B:
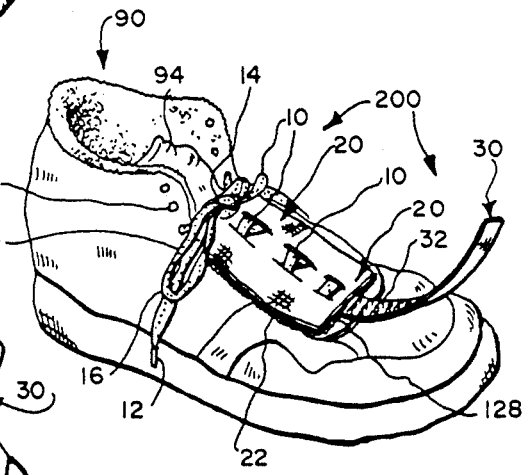
FIG. 2B is a perspective view of the shoe and lace containment device shown in FIG. 2A with shoe lace ends tied in a bow knot.
Figure 2D:
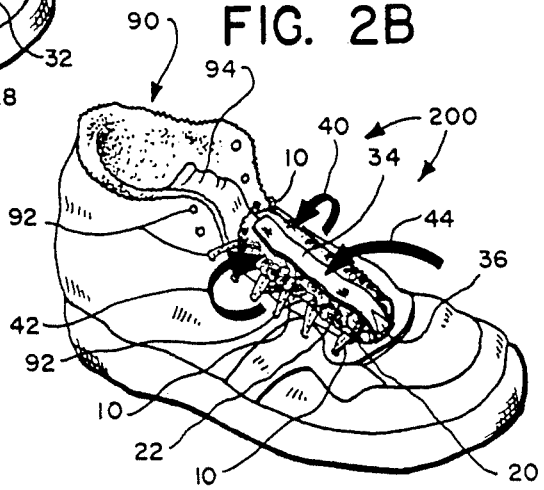
FIG. 2D is a perspective view of the shoe and lace containment device shown in FIG. 2C showing the lace ends fully enclosed by wrapping the enclosing member upon the tied lace ends and causing the engaging member compressibly engaging the folded flaps of the enclosing member to contain the laces.

FIG. 2B shows a knot 14 tied in lace ends 10. The knot 14 comprises opposed bows 16 and each tie lace end sleeve 12 residing along the lateral sides of shoe 90. While this is typically done with the user's foot in the shoe, the foot has been removed for clarity. As a first step in enclosing tied lace ends 10, each bow 16 and tie lace end sleeve 12 is placed so as to extend centrally, downwardly between the eyelets 92 as indicated by arrows 46 and 48 in FIG. 2C. Thus, the knot 14, the bows 16, the ends 10 and the sleeves 12 rest upon enclosing member 20. Finally, enclosing member 20 is folded medially from both sides as indicated by arrows 40 and 42 in FIG. 2D. With the enclosing member 20 so folded, engaging member 30 lowered upon the enclosing member 20, as indicated by arrow 44, to engage the hook and loop fasteners to releasibly contain the tie laces 10. The surface 34, opposite the loop fastener surface 32 of engaging member 30 is thereby presented to a viewer of shoe 90. Surface 34 may comprise a visual representation for advertising, design or marketing purpose.

Figure 3:
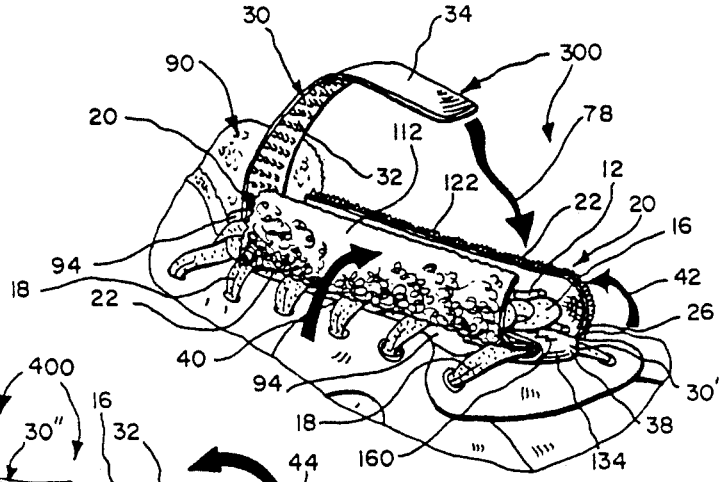
FIG. 3 is an enlarged fragmentary perspective view of a tied lace ends containment device affixed to a shoe at the lace thereof wherein an engaging member is permanently attached to an enclosing member.

Another preferred embodiment wherein enclosing member 20 and engaging member 30 are permanently joined into a single tied lace containing device 300 is shown in FIG. 3. The engaging member 30' is substantially the same as engaging member 30 except member 30' runs oppositely the full length of member 20 on the underside thereof and distal end 134 of member 30' is overlaid against a distal segment of enclosing member 20 and permanently attached by bonding, sewing (stitching), or by other suitable connection, shown at line 160 in FIG. 3. Device 300 is releasibly affixed to shoe 90 by folding engaging member 30' proximally at fold 38 and threadably engaging member 30' around at least one cross segment 18 of the lace while such is laced between lace apertures 92. Thus, engaging member 30' also performs an affixing function. As described earlier, tied lace ends 10 are contained by substantially placing bow 16, the ends 10, and tie lace end sleeve 12 upon the member 20 and thereafter properly folding the opposed side portions of member 20 toward the center as shown by arrows 40 and 42. The medially folded edges 112 and 122 of enclosing member 20 are engaged and releasibly held in a closed condition by lowering engaging member 30' in a distal motion about the enclosing member 20, as indicated by arrow 78, so that hook fastener side 32 connects to loop fastener side 22.

Figure 4:
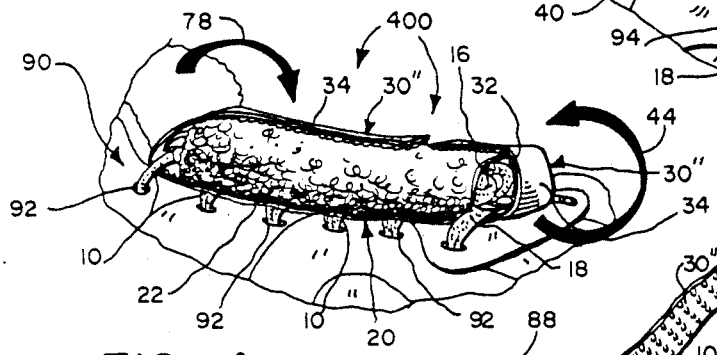
FIG. 4 is an enlarged fragmentary perspective of a tie lace containment device, attached to the tie lace of a shoe, wherein an engaging member and an enclosing member are releasibly joined.

Another presently preferred embodiment, generally designated 400, wherein the enclosing member also functions as an affixing member, is seen in FIG. 4. Similar to the embodiment seen in FIG. 3, engaging member 30'' is affixed to shoe 90 by threadably inserting engaging member 30'' between tongue 94 and at least one cross segment 18 of the lace, disposed between apertures 92. However, in the embodiment 400 seen in FIG. 4, enclosing member 20 and engaging member 30'' are releasibly connected by hook and loop fasteners. Tied lace ends 10 are folded, along with sleeves 12, loops 16, and knot 14, and enclosed by enclosing member 20 in the manner described above. Engaging member 30'' is longer than the above described engaging members. The hook fasteners of member 30'' engage the loop fasteners of member 20 along the full length thereof. Member 30'' comprises a relatively long upper tongue portion and a relative short lower tongue portion. When the upper and lower tongue portions of member 30'' are folded into firm engagement with the member 20, as illustrated in FIG. 4, by arrows 44 and 78, respectively, further hook and loop fastening occurs whereby the assembly is retained as shown. Note that engaging member 30'' is long enough to traverse both front and back of the member 20. Therefore, the length of member 30'' is about twice that of member 20.

Figure 5:
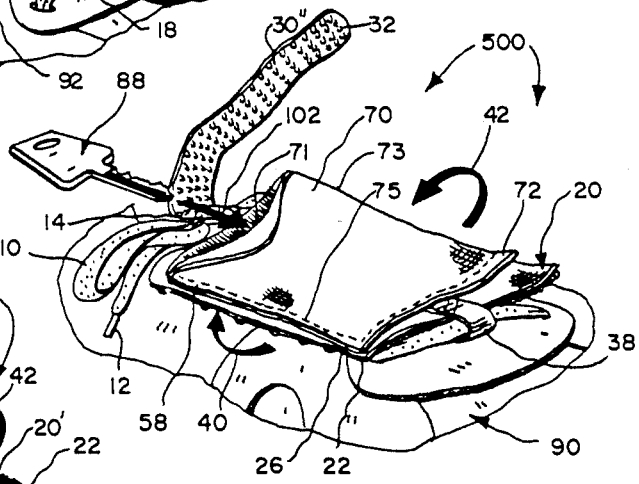
FIG. 5 is an enlarged fragmentary perspective view of a tied lace ends containment device similar to the tie lace containment device shown in FIG. 3, but comprising an additional pocket member for storage of small items.
Figure 6:
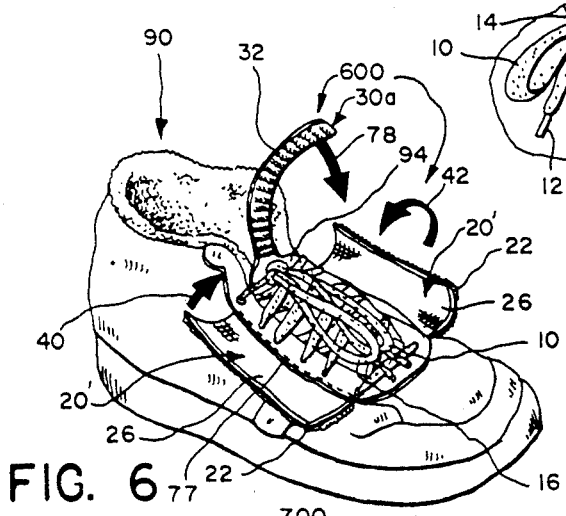
FIG. 6 is a perspective view of a tied lace ends containment device comprising members which are permanently attached to a shoe, per se.

Yet another presently preferred embodiment, generally designated 500, is seen in FIG. 5. Device 500 comprises a pocket 70, wherein there is room to store a key or other small item. Otherwise, device 500 is illustrated as comprising the same components combined in the same way as device 300. The pocket 70, as illustrated, comprises a single piece of material folded upon itself at edge 73 and sewn along hem or stitch line 72 and further sewn along line 75 at attachment side 58 to the exposed surface 26 of enclosing member 20. So formed, pocket 70 comprises a proximal opening 71 whereby an object such as key 88 is insertable, as indicated by arrow 102 When enclosing member 20 is closed by folding enclosing member (together with pocket 70) medially as shown by arrows 40 and 42 and as described above and after the folded member 20 is fastened by hook and loop engagement caused by compressive engagement of the hook fasteners at side 32 of engaging member 30 with the loop fasteners at side 22 of enclosing member 20, the assembly is releasibly held in the described encapsulatory position with pocket 70 entirely closed.

A further presently preferred embodiment comprises members of a tied lace ends containment device, generally designated 600, permanently affixed to shoe 90. See FIG. 6. Therein is seen two spaced enclosing members 20', each permanently affixed, as by stitching along lines 77 to each side of shoe 90 adjacent the eyelets 92 thereof. Device 600 also comprises an engaging member **30*a*, affixed to the upper end of shoe tongue 94. To dispose tied lace ends 10 in a contained orientation, each bow 16, the knot 14, each lace end 10, and each tie lace end sleeve 12 are gathered medially between engaging members 20' above the threaded region of the lace. The members 20' are folded over the threaded region of the lace as indicated by arrows 40 and 42, and engaging member 30 is folded distally downwardly in the direction indicated by arrow 78 such that the hook fasteners at surface 32 compressively join the loop fasteners at surface 22 to releasibly secure, conceal and contain the tied lace ends 10, the knot 14, the bow 16 and the sleeves 12**.

Figure 7:
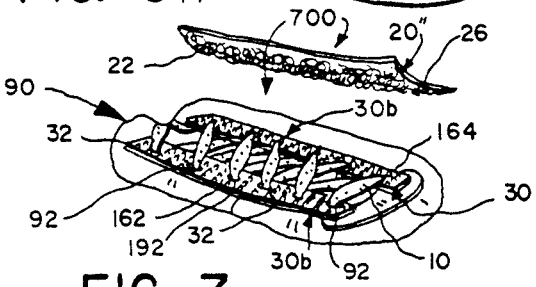
FIG. 7 is a fragmentary perspective view of a tied lace ends containment device whereby spaced engaging members are affixed to the lace of a shoe and an enclosing member is releasibly detached from the shoe and the spaced engaging members.

Still another presently preferred embodiment is seen in FIG. 7, and is generally designated 700, where two engaging members **30*b* are shown comprising two strips 162 and 164. The top surface of both strips 162 and 164 comprise hook fasteners. Each strip 162 and 164 comprise lace-receiving apertures 192 which are spaced at distances the same as the separation between apertures 92. The lace is threaded through aligned apertures 192 and 92, as shown in FIG. 7. The upright hook fasteners at side 32 of each strip 162 and 164 are secured to enclosing means 20'' to enclose the tied lace ends 10, the bows 16, the knot 14, and the sleeves 12**.

Figure 8:
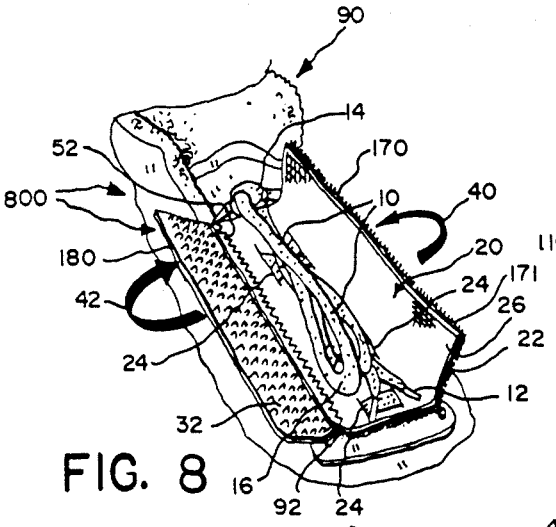
FIG. 8 is an enlarged fragmentary perspective view of a one piece tied lace ends containment device wherein an enclosing member and an engaging member comprise a single unit.

Examples of tied lace ends containment devices which attach, enclose, secure and engage the end portions of a shoe lace have been described. A further presently preferred tied lace ends containment device 800 comprising a single integrated unit is in FIG. 8. Single unit device 800, as seen in FIG. 8, comprises a first flap 170 which functions as an enclosing member, in the manner described above, and a second flap 180 which functions as an engaging member 30, in the manner described above. The enclosing flap 170 of the tied lace ends containment device 800 seen in FIG. 8 comprises loop fastener 22 disposed along a surface disposed away from the lace and slits 24 located in a longitudinal direction at a fold line of enclosing flap 170 in alignment with apertures 92, by which the shoe lace releasibly attaches the tied lace ends containment device 800 to shoe 90. As seen in FIG. 8, the loop fasteners 22 of enclosing strip 170 are disposed away from the lace such that each sleeve 12, lace ends 10, and bows 16 are disposed next to inner side 26 of enclosing strip 170. The engaging flap 180 is illustrated as being sewn to flap 170 along zig-zag stitch line 52, although other ways of fastening the two flaps together are within the scope of this invention. In use, the lace threaded through shoe eyelets 92 (some of which are not shown in FIG. 8) and through aligned slits 24 in the flap 170 to thereby releasibly affix the tied lace ends containment device 800 to the shoe 90. After each end 10 of a lace is collected and tied into a knot 14 or the like, each bow 16, the knot, the ends 10, and the sleeves 12 are gathered upon the flap 170 above the threaded part of the lace, as shown in FIG. 8. Flap 170 is folded upon itself as indicated by arrow 40 bringing side surface 26 into contiguous relationship with the loops 16, ends 10, sleeves 12 and knot 14. Flap 180 is then folded essentially adjacent to the stitch line 52, as indicated by arrow 42, to compressively engage the contiguous hook and loop fasteners of flap 170 and 180 to secure the tied lace ends 10 within the device 800.

Figure 9:
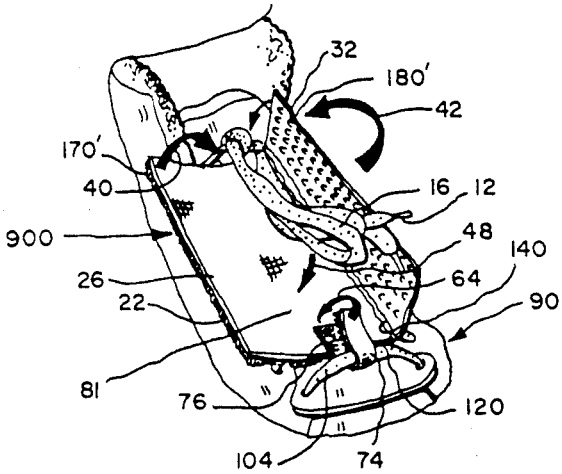
FIG. 9 is an enlarged fragmentary perspective view of a one piece tied lace ends containment device wherein an engaging member and an attaching member are bonded to an enclosing member and the attaching member forms a releasible, self attaching loop, a portion of which is bonded to the enclosing member an wrapped around a single tie lace of a shoe which is only seen in part.

Another embodiment of a single unit tie lace containment device, generally designated 900, is seen in FIG. 9. The embodiment of FIG. 9 is substantially similar to the embodiment 800 of FIG. 8 except for the differences explained hereinafter. Second flap 180' is adhesively or thermally bonded to flap 170' along attachment line 140 to form the single unit tied lace containment device 900.

Rather than employing slits, an affixing member 74 is bonded at 81 to the distal end 120 of flap 170'. Affixing member 74 comprises opposed hook and loop fasteners at surface 76 such that when member 74 is wrapped around lace cross segment 104 and contiguously and compressively folded upon itself, as indicated by arrow 64, a releasible attachment of the device 900 to the shoe results. The flap members 170' and 180' are thereafter folded over top of the knot 14, loop 16, ends 10 and sleeves 12 and into overlapping relation as indicted by arrows 40 and 42 and as described above in conjunction with device 800.

Figure 10:
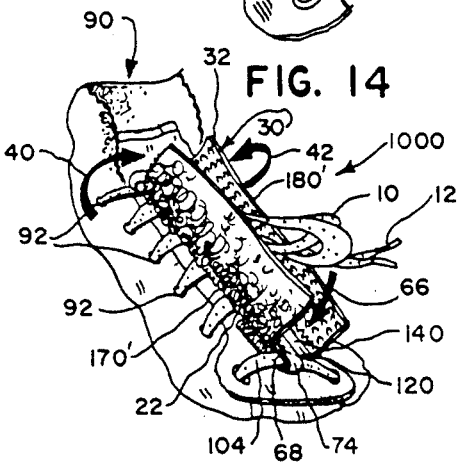
FIG. 10 is an enlarged fragmentary perspective view of a one piece tied lace ends containment device similar to the device shown in FIG. 9, except the attaching loop is affixed on one end to one side of an enclosing member and releasibly attaches to the other side of the enclosing member after forming a loop around a single tie lace of a shoe.

Yet another embodiment of a single unit tie lace containment device, generally designated 1000, is seen in FIG. 10. Device 1000 differs in that affixing member 74 comprises hook fasteners disposed on at least one side and is permanently attached by sewing or bonding at zig-zag stitch line 68 to the distal end 120 of flap 170'. The hook fasteners of member 74 are placed against the inner side 26 of flap 170' such that after affixing member 74 is wrapped around a distal lace segment 104 the hooked surface of affixing member 74 is compressively, releasibly attached to the loop fasteners disposed at surface 22 of the flap 170' to fasten the tied lace ends containment device 1000 to the shoe 90. After gathering the tied lace ends, etc., as heretofore described, flap 170' is folded inward followed by flap 180' as indicated by arrows 40 and 42 in FIG. 10, whereby hook fasteners are compressively adjoined to loop fasteners to secure tied lace ends 10, etc. within the containment of device 1000.

Figure 11:
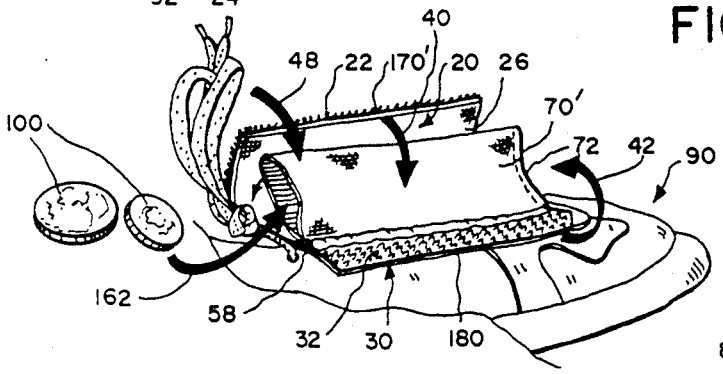
FIG. 11 is an enlarged fragmentary perspective view of a one piece tied lace ends containment device, similar to the device seen in FIG. 8, but further comprising a pocket member.

A pocket 70', (FIG. 11) may be used for storing and transporting small items within a tied lace ends containment device of the type shown and described in conjunction with FIGS. 8–10. Pocket 70' is formed by folding a swatch of material and closing it at the bottom 72 by a stitched hem and along attachment side 58 where pocket 70' is also fastened to flap 180'. Pocket 70' is adaptable for use in any of single unit tied lace ends containment devices formed in accordance with the present invention. As seen in FIG. 11, contents 100 shown as being coins, are inserted as indicated by arrow 162. Once contained in pocket 70', contents 100 are firmly held by disposition of pocket 70' on shoe 90 contiguous with the tied lace ends 10 and wrapping the flaps 170' and 180' upon each other to engage the hook and loop fasteners in the manner explained above.

Figure 12:
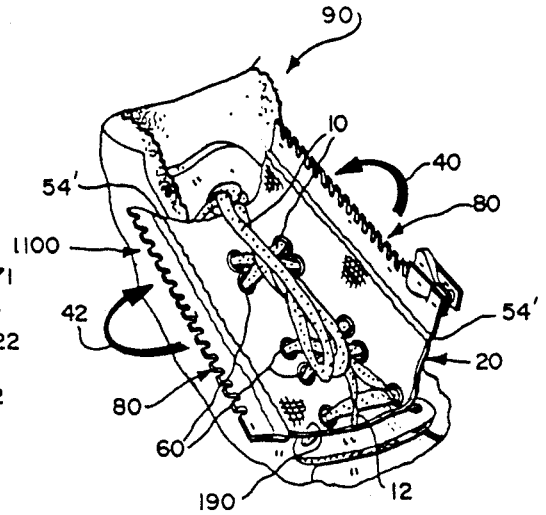
FIG. 12 is an enlarged fragmentary perspective view of a one piece tied lace ends containment device comprising eyelet protected apertures which receive the lace to secure the device to the shoe and wherein the engaging device comprises a zipper.
Figure 13:
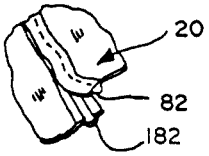
FIG. 13 is an enlarged fragmentary perspective view of a one piece tied lace ends containment device engaging member made from deformable, interlocking plastic ridges and grooves.
Figure 14:
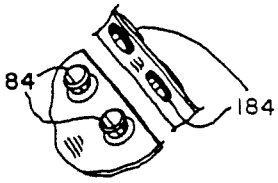
FIG. 14 is an enlarged fragmentary perspective view of a one piece tied lace ends containment device engaging member comprising releasibly connectable snaps.

While material comprising hook and loop fasteners is very functional for use as part of tied lace end containment devices of the present invention, other types of fasteners, such as those shown in FIGS. 12–14 may be employed within the scope of the invention. A zipper 80 is shown in FIG. 12 as being connected directly to an enclosing member along attachment lines 54' as seen in FIG. 12. Eyelets 60 are illustrated in FIG. 12 as receiving cross segments of the lace to secure the containment device 1100 of FIG. 12 to the shoe.

Preformed pliable synthetic resinous material in the form of an interlocking rib and a groove to form a releasible plastic engagement 82 may be used to releasibly fasten the containment device to itself, as seen in FIG. 13. Further, metal snaps 84 and 184, as seen in FIG. 14, provide another fastener alternative for containment devices according to the present invention.

As consistently presented heretofore, laces have been referred to as tied laces and containment devices as tied lace containment devices to emphasize a primary operational mode of the invention. However, there are a number of occasions when it is desirable to contain loose or untied lace ends on footwear worn by a youngster who has not yet learned to tie laces but has learned to enclose and engage a tied lace containment device and on footwear hurriedly donned wherein the wearer is not able to or does not wish to take time to tie the laces. In such cases, the laces may be gathered or folded untied within a tied lace containment device for containment without a knot or bow.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Pliant structure for completely enclosing and containing footwear tie lace ends comprising:

means by which at least one part of the structure is secured to the footwear;

lace ends enclosing and containing means comprising means manually rotatable from a position exposing the lace ends to another position completely enclosing and containing the lace end whereby damage and soiling of the lace ends is avoided and the lace ends are not available to be snagged on objects or stepped on by a wearer, the lace ends enclosing and containing means further comprising first releasible fastening means disposed away from the lace ends when in either position; and means by which the lace ends enclosing and containing means and the so completely enclosed and contained lace ends are selectively releasibly held in the second position against inadvertent displacement, the releasible holding means comprising second releasible fastening means at least a part of which are moved relative to the enclosing and containing means to selectively engage the first releasible fastening means to maintain said second position.

2. Pliant structure according to claim 1 wherein the shoe securing means comprise permanent attachment means.

3. Pliant structure according to claim 2 wherein the permanent attachment means comprise bonding means.

4. Pliant structure according to claim 2 wherein permanent attachment means comprise stitched means.

5. Pliant structure according to claim 1 wherein the shoe securing means comprise releasible means.

6. Pliant structure according to claim 5 wherein said releasible means comprise lace-receiving eyelet means.

7. Pliant structure according to claim 5 wherein the releasible means comprise at least one of hook fastener means and loop fastener means.

8. Pliant structure according to claim 1 further comprising article-receiving pocket means which are substantially enclosed by the manually rotating means when in the other position.

9. Pliant structure according to claim 1 wherein the securing means comprise lace-receiving aperture means through which laces are placed to attach the securing means to the footwear.

10. Pliant structure according to claim 9 wherein the lace-receiving aperture means comprise slits in the securing means.

11. Pliant structure according to claim 9 wherein the lace-receiving aperture means comprise eyelet means.

12. Pliant structure according to claim 9 wherein the lace-receiving aperture means comprise nonreinforced holes.

13. Pliant structure according to claim 1 wherein the fastening means comprise zipper means.

14. Pliant structure according to claim 1 wherein the fastening means comprise snap means.

15. Pliant structure according to claim 1 wherein the fastening means comprise interlocking synthetic resinous parts.

16. Pliant structure according to claim 1 wherein the securing means comprise linkage means releasibly connected to the tie lace.

17. Pliant structure according to claim 1 wherein the releasible holding means are removably secured to the remainder of the pliant structure.

18. Pliant structure according to claim 1 wherein the releasible holding means are permanently connected to another portion of the pliant structure 19. Pliant structure according to claim 1 wherein the securing means are permanently connected to the footwear.

20. Pliant structure according to claim 1 wherein the releasible holding means are permanently connected to the footwear.

21. Pliant structure according to claim 20 wherein the permanent connection comprises means permanently attaching the releasible holding means to tongue means of the footwear.

22. Pliant structure according to claim 1 wherein the first and second releasible fastening means comprise complementary hook and loop fasteners.

23. Pliant structure according to claim 22 wherein at least one of the securing means, the lace ends enclosing and containing means and the releasible holding means comprise exposed surface area means for displaying identification, advertising and the like.

24. Pliant structure according to claim 1 wherein one or more of the securing means, the lace ends enclosing and containing means and the releasible holding means comprise fabric means.

25. Pliant structure according to claim 1 wherein at least some of the securing means is disposed beneath lace segments threaded through the shoe.

26. Pliant structure according to claim 26 wherein at least some of the securing means is disposed above lace segments threaded through the shoe.

27. Pliant structure according to claim 1 wherein the manually rotatable means comprise at least two flap means which are oppositely rotated toward each other to achieve the other position.

28. Pliant structure according to claim 1 wherein the releasible holding means is connected to an initially concealed portion of the securing means.

29. Pliant structure according to claim 1 wherein the releasible holding means is connected to an initially exposed portion of the securing means.

30. Pliant structure according to claim 1 wherein the securing means and the lace ends enclosing and containing means integrally comprise a single piece of material.

31. Pliant structure according to claim 1 wherein the securing means comprise two pieces disposed on each-side of lace segments threaded through the shoe.

32. Pliant structure according to claim 1 wherein the holding means comprise a single piece of material.

33. Pliant structure according to claim 1 wherein the securing means is disposed above at least some lace segments threaded through the shoe, the manually rotatable means is initially disposed along one side of the securing means and the releasible holding means is initially disposed along a second side of the securing means.

34. Pliant structure according to claim 33 wherein the securing means is side edge connected to the manually rotatable means and the releasible holding means.

35. Pliant structure according to claim 1 wherein the releasible holding means is secured to itself around lace segment means threaded through the shoe, by releasible fastener means.

36. Pliant structure for substantially enclosing and containing footwear tie lace ends comprising:

means by which at least one part of the structure is secured to the footwear;

lace ends covering means comprising means manually rotatable from a position exposing the lace ends to another position substantially covering the lace ends, the lace ends covering means further comprising first releasible fastening means located away from the lace ends when in either position;

means by which the lace ends covering means and the covered lace ends are selectively releasibly held in the second position against inadvertent displacement, the releasible holding means comprising second releasible fastening means which selectively engage the first releasible fastening means to maintain said second position; and the securing means being superimposed upon lace segments across the shoe, the lace ends covering means being superimposed upon the securing means and the lace ends when in the second position and the releasible holding means being disposed upon the lace ends covering means.

37. A method of securely containing footwear tie lace ends comprising the following steps:

affixing lace ends covering and enclosing structure to a shoe;

placing the covering and enclosing structure contiguously around the lace ends; and releasibly locking the covering and enclosing structure in the aforesaid position contiguously around the lace ends to completely enclose the lace ends and to prevent both inadvertent separation of the lace ends from the covering and enclosing structure and substantial movement of the covering and enclosing means with the lace ends therein relative to the shoe whereby the lace ends are not soiled or damaged and may not be caught upon external objects or stepped upon.

38. A method according to claim 37 further comprising the step of displaying information at an exposed area of the covering and enclosing structure when in the releasibly locked position.

39. A method for containing footwear tie lace ends comprising the following steps:

providing tie lace enclosing means;

providing enclosing means engaging means;

affixing enclosing means and engaging means to each other and to at least one anchoring segment of the footwear tie laces;

tying or otherwise joining the free footwear tie lace ends;

folding each loose tie lace end into a containment site in the enclosing means;

enclosing all of any loose portions of the tie lace end segments in the enclosing means;

moving an engaging means to releasibly engage the enclosing means to completely enclose the loose portions whereby soiling, catching and stepping upon any said loose portion are prevented.

40. A method for containing footwear tie laces and retaining associated tie-lace-end-joining knot comprising the following steps:

providing tie lace containing means;

providing enclosing means engaging means;

affixing enclosing means and engaging means to each other and to at least one anchoring segment of the footwear tie laces;

tying a knot in the footwear tie lace ends;

folding all of any loose or free portions of each tie lace end and of the knotted segment into a containment site in the enclosing means;

enclosing the knot and the loose or free portions of each tie lace end in the containment site into the enclosing means; and moving an engaging means to releasibly engage the enclosing means to completely enclose the loose or free portions whereby soiling, catching and stepping upon any said loose or free portion are prevented.

41. A method for containing footwear tie laces comprising the following steps:

providing tie lace enclosing means;

providing enclosing means engaging means;

affixing enclosing means and engaging mans to each other and to at least one anchoring segment of the footwear tie laces by linking the engaging means around a tie lace anchoring segment;

tying or otherwise joining the free footwear tie lace ends;

folding each tie lace end into a containment site in the enclosing means;

enclosing all of each tie lace end segment in the containment site into enclosing means; and moving an engaging means to releasibly engage the enclosing means to completely enclose each tie lace end segment whereby soiling, catching and stepping upon any tie lace end segment are prevented.

42. A method for containing footwear tie laces in a tie lace containment means and for securely and conveniently storing an item for transport in a pocket in the lace containment means, comprising the following steps:

providing tie lace containing means comprising at least one pocket;

affixing enclosing means and engaging means to each other and to at least one anchoring segment of the footwear tie laces;

tying or otherwise joining the free footwear tie lace ends;

folding each tie lace end into a containment site in the enclosing means;

enclosing all of each tie lace end segment in the enclosing means;

storing the item in the pocket; and moving an engaging means to releasibly engage the enclosing means to completely enclose each tie lace end segment against soiling, catching and being stepped upon and releasibly restraining the item in the closed pocket.

43. A process for producing and disposing for use a footwear tie lace containing device comprising the following steps:

stamping or cutting an enclosing member from loop material; and stamping or cutting an engaging member from hook material;

attaching the enclosing member to a piece of footwear;

releasibly attaching the engaging member to the enclosing member on the footwear;

whereby the enclosing member comprises free parts to rotatingly completely enclose ends of the tie laces on the footwear and the engaging member comprises at least one free part which is moved to engage the enclosing member when the enclosing member is enclosing the ends of the tie laces whereby the ends of the tie laces are completely confined against soiling, catching upon an object or being stepped upon.

* * * * *